US005918385A

United States Patent [19]

Sessa

[11] Patent Number: 5,918,385

[45] Date of Patent: Jul. 6, 1999

[54] FOOTWEAR SOLE

[76] Inventor: Raymond V. Sessa, 5123 S. Quail Crest Dr. SE., Grand Rapids, Mich. 49546

[21] Appl. No.: 09/022,235

[22] Filed: Feb. 11, 1998

[51] Int. Cl.[6] ..... A43B 23/28; A43B 13/18; A43B 13/00

[52] U.S. Cl. ..... 36/59 C; 36/25 R; 36/28

[58] Field of Search ..... 36/28, 134, 126–129, 36/59 C, 59 R, 25 R, 30 R, 32 R

[56] References Cited

U.S. PATENT DOCUMENTS

| | | | |
|---|---|---|---|
| D. 185,462 | 1/1959 | Ratner | D2/320 |
| D. 195,542 | 7/1963 | Webster | D2/320 |
| D. 203,577 | 2/1966 | Weinberg | D2/320 |
| D. 233,637 | 11/1974 | Askew | D2/320 |
| D. 266,287 | 9/1982 | Blissett et al. | D2/320 |
| D. 287,303 | 12/1986 | Peterson | D2/318 |
| D. 360,065 | 7/1995 | Werman | D2/953 |
| D. 363,371 | 10/1995 | Werman | D2/957 |
| D. 372,576 | 8/1996 | Mills et al. | D2/960 |
| D. 377,260 | 1/1997 | Bramani | D2/954 |
| 1,286,169 | 11/1918 | Brockett . | |
| 3,006,085 | 10/1961 | Bingham, Jr. | 36/59 C |
| 3,018,571 | 1/1962 | Doherty . | |
| 3,316,662 | 5/1967 | Schmadeke . | |
| 3,555,697 | 1/1971 | Dassler | 36/59 C X |
| 3,717,943 | 2/1973 | Orndorff, Jr. | 36/59 C X |
| 3,748,951 | 7/1973 | Orndorff, Jr. | 36/32 R X |
| 4,045,888 | 9/1977 | Oxenberg | 36/114 |
| 4,060,917 | 12/1977 | Canale | 36/59 C |
| 4,372,058 | 2/1983 | Stubblefield | 36/114 |
| 4,375,728 | 3/1983 | Dassler | 36/59 C X |
| 4,404,759 | 9/1983 | Dassler | 36/129 |
| 4,521,979 | 6/1985 | Blaser | 36/59 C X |
| 4,569,142 | 2/1986 | Askinasi | 36/59 C X |
| 4,607,440 | 8/1986 | Roberts et al. | 36/114 |
| 4,741,114 | 5/1988 | Stubblefield | 36/32 R |
| 5,014,449 | 5/1991 | Richard et al. | 36/114 |
| 5,367,792 | 11/1994 | Richard et al. | 36/114 |
| 5,761,832 | 6/1998 | George | 36/59 C |
| 5,768,802 | 6/1998 | Bramani | 36/59 C X |

*Primary Examiner*—B. Dayoan
*Attorney, Agent, or Firm*—Warner Norcross & Judd

[57] ABSTRACT

An outsole for an article of footwear having inclined lugs that protrude downwardly from the bottom of the outsole. The outsole defines an undercut around at least a portion of each lug to permit the lugs to collapse into the outsole when walking on hard, flat surfaces. The lugs in the forefoot portion of the outsole are inclined rearwardly and the lugs in the heel portion of the outsole are inclined forwardly. In a second aspect, the outsole includes a plurality of downwardly protruding ridges that undulate around the profile of the outsole in a generally horizontal direction to provide the profile of the outsole with a gripping surface.

12 Claims, 3 Drawing Sheets

FOOTWEAR SOLE

BACKGROUND OF THE INVENTION

The present invention relates to footwear, and more particularly to a sole for an article of footwear.

There has been an increase in the popularity of hiking, walking, and other outdoor recreational activity. The footwear industry has responded by increasing its efforts in the design and manufacture of outdoor footwear. These efforts are directed primarily to the production of footwear that is both comfortable and provides improved traction on outdoor terrain.

Hikers and other outdoor enthusiasts often travel over rugged and uneven terrain, such as climbing or descending a rocky slope or a cliff. When traveling over sloped terrain, there is a tendency for the footwear to slip out from beneath the wearer down the slope as weight is applied during the down-step. This problem increases as the terrain becomes more extreme. In fact, when traveling over extreme terrain, such as rock faces and steep cliffs, the wearer will often engage the terrain with the profile (i.e. the side) or toe of the outsole to improve traction.

In an effort to address these problems, outdoor footwear typically includes lugs that protrude from the bottom of the outsole to engage the ground. While these lugs grip uneven surfaces in the terrain and provide improved traction, they are typically manufactured from relatively hard materials. This generally results in an outsole that is relatively stiff and uncomfortable, particularly when walking on hard, flat surfaces. Further, these lugs typically extend only from the bottom surface of the outsole. As a result, they do not improve traction when traveling over extreme terrain where the wearer may engage the ground with the profile or toe of the outsole.

SUMMARY OF THE INVENTION

The aforementioned problems are overcome by the present invention wherein an outsole is provided with sloped lugs and an undercut defined around a portion of each lug. The undercuts permit the lugs to collapse into the outsole when traveling over hard, flat terrain. The lugs in the forefoot portion of the outsole are inclined rearwardly to provide improved traction for climbing uphill while the lugs in the heel portion of the outsole are inclined forwardly to provide improved traction for descending downhill. The bottom surface of each lug is preferably concave thereby improving the flexibility of the lugs.

In a second aspect, the present invention provides an outsole having rows of downwardly protruding ridges that extend around the profile and under the toe of the outsole. The ridges undulate as they extend around the outsole in a generally horizontal direction. The ridges are vertically offset from one another and are of sufficient dimension to engage and grip uneven surfaces.

The present invention provides an outsole specially adapted for outdoor use. The inclined lugs provide improved traction when ascending and descending over rough terrain. The undercuts permit the lugs to collapse into the outsole on hard flat surfaces, thereby providing improved comfort and significant energy return when weight is lifted from the outsole. Also, the profile ridges provide improved traction when the profile or toe of the outsole is used as a gripping surface in climbing or descending extreme terrain.

These and other objects, advantages, and features of the invention will be readily understood and appreciated by reference to the detailed description of the preferred embodiment and the drawings.

DETAILED DESCRIPTION OF THE PREFERRED EMBODIMENT

Figure 2:
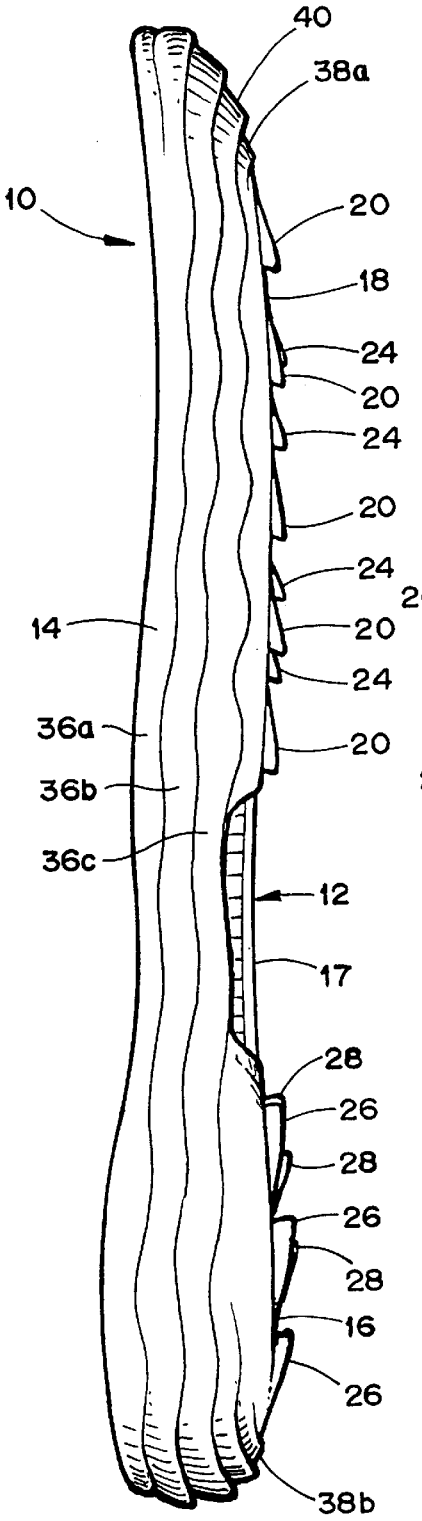
FIG. 2 is a side elevational view of the outsole.
Figure 1:
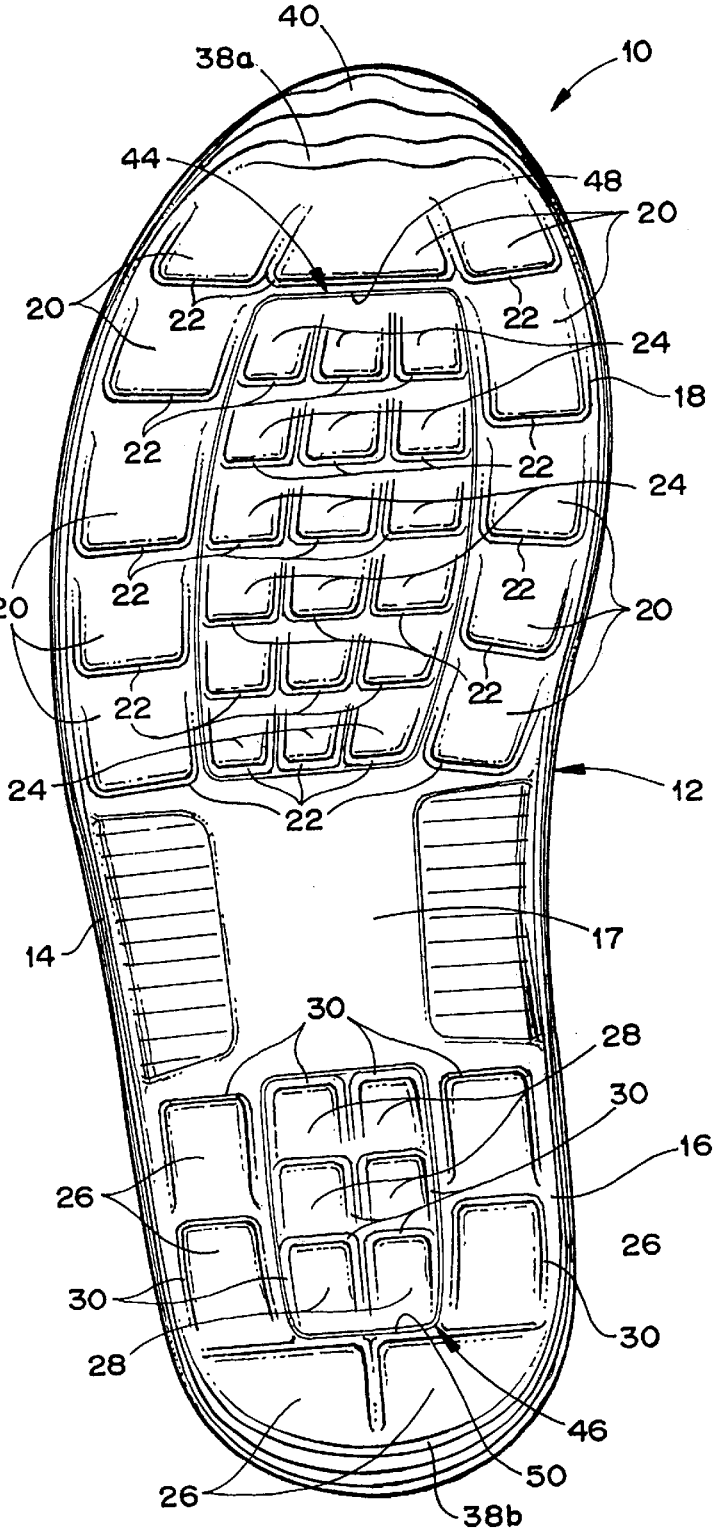
FIG. 1 is a bottom plan view of an outsole according to a preferred embodiment of the invention.
Figure 3:
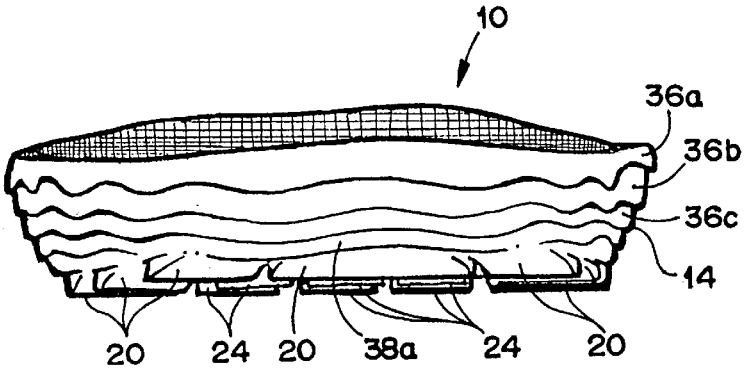
FIG. 3 is a front elevational view of the outsole.

An outsole according to a preferred embodiment is illustrated in FIGS. 1–3, and is generally designated 10. The outsole 10 is designed primarily for outdoor use and can be integrated with virtually any upper design. For example, the outsole can be incorporated into walking shoes, hiking boots, and other outdoor footwear. In addition, the outsole can be used with conventional full, three-quarter, mid, and low height uppers. Given that the particular design of the upper is not part of the present invention, the upper will not be described in detail. Suffice it to say that the outsole 10 is designed to be attached to a conventional upper using conventional techniques and apparatus.

Referring now to FIGS. 1 and 2, the outsole 10 generally includes a base 12 extending substantially horizontally and a circumferential profile 14 extending substantially vertically upward around the entire periphery of the base 12. The base 12 generally includes a heel portion 16 corresponding with the heel portion of the wearer's foot, a central portion 17 corresponding with the arch portion of the wearer's foot, and a forefoot portion 18 corresponding with the forefoot portion of the wearer's foot. The outsole 10 includes a plurality of rearwardly inclined peripheral lugs 20 that extend downwardly from the base 12 adjacent to the periphery of the forefoot portion 18, as well as a plurality of forwardly inclined peripheral lugs 26 that extend downwardly from the base 12 adjacent the periphery of the heel portion 16. The rearwardly inclined peripheral lugs 20 include a row of three lugs extending across the front of the forefoot portion 18 and two rows of four additional lugs extending along opposite sides of the forefoot portion 18. The forwardly inclined peripheral lugs 26 include a row of two lugs extending across the rear of the heel portion 16 and two rows of two additional lugs extending along opposite sides of the heel portion 16.

The outsole 10 further includes a plurality of rearwardly inclined internal lugs 24 that extend downwardly from the base 12 in six transverse rows, each row including three lugs. The rearwardly inclined internal lugs 24 are disposed inwardly from peripheral lugs 20 in the forefoot portion 18. The outsole also includes a plurality of forwardly inclined internal lugs 28 that extend downwardly from the base 12 in three transverse rows, each row including two lugs. The forwardly inclined internal lugs 28 are disposed inwardly from peripheral lugs 26 in heel portion 16. As shown in FIGS. 1 and 2, the internal lugs 24 and 28 preferably have the same height as but are smaller in width and length than the peripheral lugs 20 and 26. The size of the internal and peripheral lugs 20, 24, 26, and 28 will vary from application to application in both real terms and in relative terms. For example, the height, width, and length of the internal lugs and/or the peripheral lugs may vary. The number and arrangement of lugs described in connection with the preferred embodiment is also merely exemplary, and may also vary from application to application.

Figure 4:
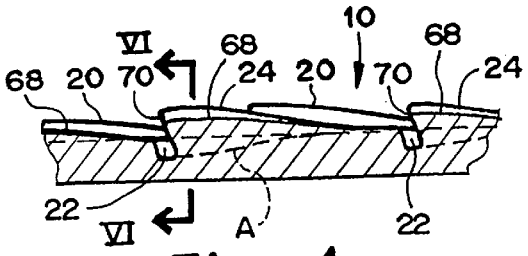
FIG. 4 is a sectional view of the forefoot portion of the outsole showing a rearwardly inclined lug.
Figure 6:
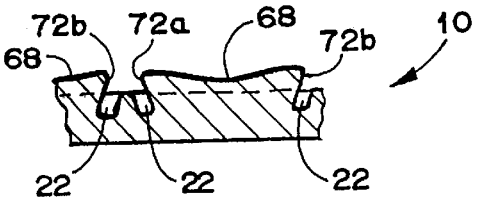
FIG. 6 is a sectional view of the outsole taken along line VI—VI of FIG. 4.

Referring now to FIGS. 4 and 6, each lug includes a major surface 68, an end wall 70, and a pair of side walls 72*a–b*. The major surface 68 is angled upwardly from the base 12 at an approximately 10 degree angle and is concave to provide the lug with improved flexibility. The amount of concavity in the major surface 68 increases along the lug in proportion to its height. As shown in FIG. 4, the major surface 68 is substantially planar as it begins to extend from the base 12 and it becomes increasingly concave as it approaches end wall 70. The end wall 70 and the side walls 72*a–b* are angled outwardly from the base 12 at an approximately 40 degree angle. The base 12 defines an undercut 22 extending across the rear and along the sides of each of the rearwardly inclined lugs 20 and 24 (See FIG. 1). As shown by hidden line A in FIG. 4, the depth of the undercut 22 is progressively reduced toward the front of each lug 20 and 24. Similarly, the base 12 defines an undercut 30 extending across the front and along the sides of each of the forwardly inclined lugs 26 and 28 (See FIG. 1). The depth of the undercut 30 is progressively reduced toward the rear of each lug 26 and 28.

Figure 8:
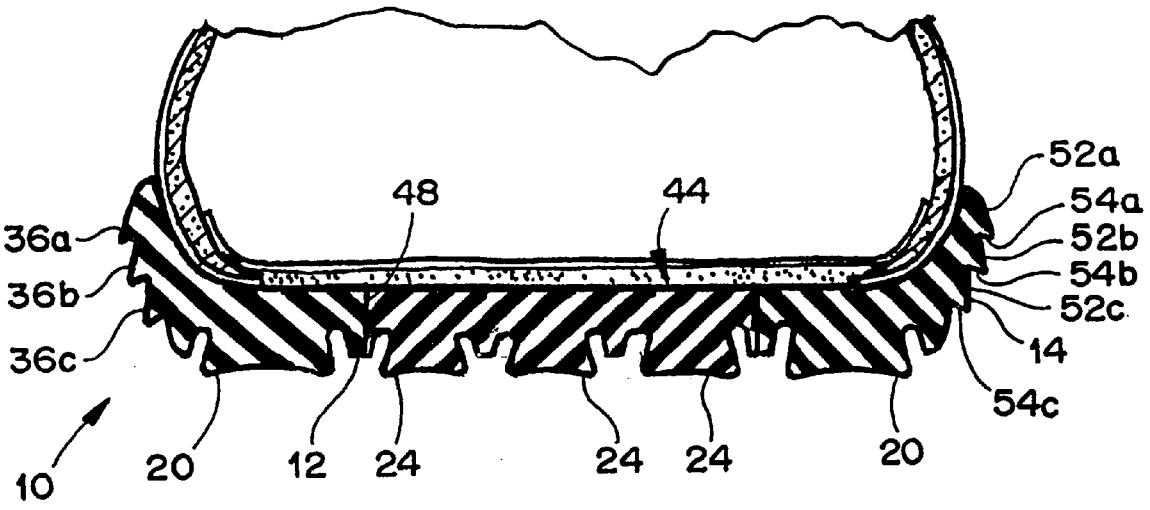
FIG. 8 is a sectional view of a portion of the outsole showing it attached to an upper.

The outsole 10 is preferably manufactured from two distinct elastomers (See FIG. 8). The majority of the outsole 10 including the peripheral lugs 20 and 26 is preferably manufactured from an elastomer having a relatively high durometer value. This material improves the durability of the outsole 10. The internal lugs 24 and 28 are preferably manufactured from an elastomer having a relatively low durometer. The lower durometer material improves the flexibility and resiliency of the outsole 10 thereby providing greater comfort. In order to provide a dual-durometer outsole 10, the internal lugs 24 and 28 are preferably integrated into front and rear inserts 44 and 46, respectively, that are secured within voids 48 and 50, respectively, defined in the outsole 10. The voids 48 and 50 preferably extend entirely through the base 12 of the outsole 10 and the inserts 44 and 46 extend entirely through and fill the voids 48 and 50. FIG. 8 shows the front insert 44 installed within the front void 48. Alternatively, voids 48 and 50 can be replaced by cups or pockets (not shown) that extend only partially into the base 12. The front and rear inserts 44 and 46 are preferably molded in place within voids 48 and 50 using conventional molding techniques and apparatus. Alternatively, the inserts 44 and 46 can be manufactured separately and secured within the voids 48 and 50 by cement, adhesive or other conventional techniques.

As noted above, the profile 14 of the outsole 10 extends vertically upward from the base 12 around the entire periphery of the sole. The profile 14 extends slightly outwardly around the sides and rear of the outsole 10 (See FIG. 8), however, it extends more significantly outwardly at the front of the outsole 10 (See FIG. 2). Due to this variation, the profile 14 defines a tapered toe portion 40 at the front of the outsole 10 (See FIGS. 2 and 9–11). The outer surface of the profile 14 includes a plurality of ridges 36*a–c* that undulate about a substantially horizontal line extending around the outsole 10. Each ridge 36*a–c* protrudes downwardly and includes a substantially vertical outer surface 52*a–c* and a downwardly inclined bottom surface 54*a–c*. As perhaps best shown in FIG. 8, the ridges 36*a–c* are vertically offset from one another to provide a wider gripping surface.

Because the profile 14 is more severely inclined at the toe portion 40, the ridges 36*a–c* are spread-out slightly and wrap beneath the toe portion 40 of the outsole 10. The toe portion 40 also includes ridge segment 38*a* which undulates across the toe portion 40 below ridges 36*a–c*. Similarly, the heel portion 56 of the outsole 10 also includes ridge segment 38*b* which undulates across the heel portion 56 below ridges 36*a–c*. Like ridges 36*a–c*, the ridge segments 38*a–b* extend downwardly from the outsole.

The inner surface 42 of the profile 14 is substantially smooth and is adapted to be interconnected with the upper (See FIG. 8) using conventional techniques and apparatus. The inner surface 42 can be textured if desired to improve its connection with the upper.

Manufacture and Use

The present invention is manufactured using conventional molding techniques and apparatus. As noted above, the outsole 10 is preferably manufactured from elastomers having different durometers. In a preferred embodiment, the majority of the outsole 10 is molded from a relatively high durometer material using conventional molding techniques and apparatus. This portion of the outsole 10 is molded with voids 48 and 50 which are adapted to receive inserts 44 and 46. After the outsole is molded with voids 48 and 50, the inserts 44 and 46 are preferably molded in place within the voids 48 and 50. The outsole with voids 48 and 50 is placed within the appropriate mold cavity (not shown) and molten material of a lower durometer is pour or injection molded into the voids 48 and 50 using conventional techniques and apparatus. Once the lower durometer material is sufficiently cured, the outsole 10 is removed from the mold cavity (not shown) and is ready for incorporation into the desired article of footwear. Alternatively, the entire outsole can be manufactured from a single elastomeric material. This alternative provides the benefit of allowing the entire outsole to be manufactured in a single molding step.

The steps involved in incorporating the outsole 10 into an article of footwear are conventional and therefore will not be described in detail. Suffice it to say that a mid-sole, insole, upper and other conventional footwear elements are interconnected with the outsole using conventional techniques and apparatus. For example, an upper and an insole can be cemented and/or stitched to the outsole.

Figure 5:
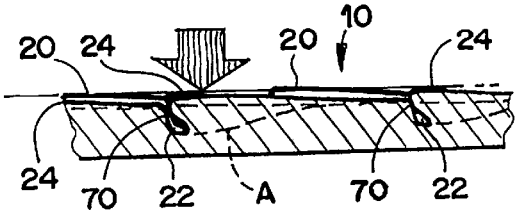
FIG. 5 is a sectional view similar to FIG. 4 showing the lug in a collapsed state.
Figure 7:
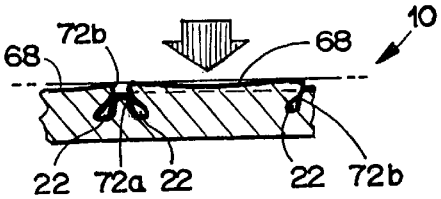
FIG. 7 is a sectional view similar to FIG. 6 showing the lugs in a collapsed state.
Figure 9:
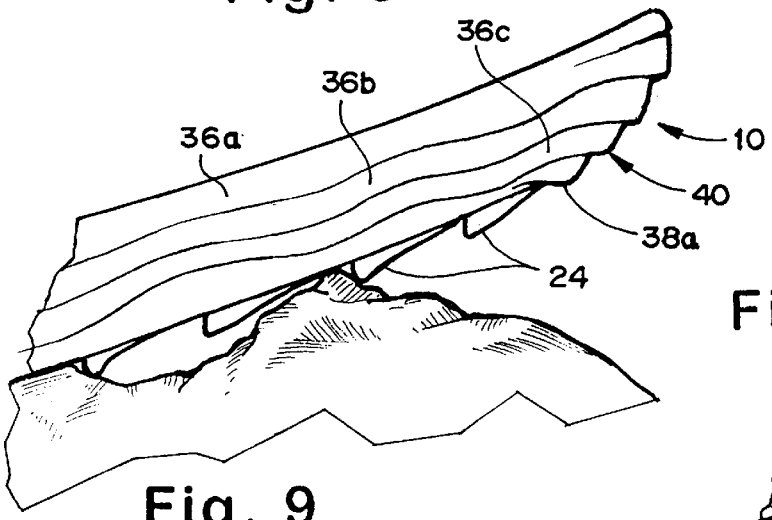
FIG. 9 is is a representational view showing the outsole engaging and gripping an uneven surface.
Figure 10:
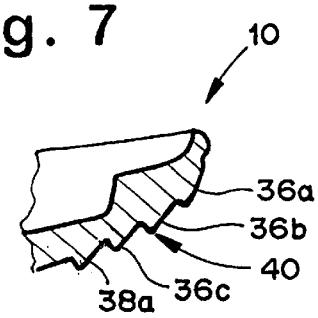
FIG. 10 is a sectional view of a portion of the outsole showing the profile ridges at the toe of the outsole.

The outsole 10 of the present invention provides improved traction and comfort on outdoor terrain as well as on indoor surfaces. As shown in FIG. 9, the rearwardly inclined lugs 20 and 24 engage and grip uneven surfaces when walking uphill or over level terrain. While not illustrated, the forwardly inclined lugs in the heel portion 16 of the base 12 engage and grip uneven surfaces when walking downhill. This arrangement is particularly advantageous because the wearer's weight will typically be applied to the forefoot portion 18 of the outsole 10 when climbing uphill and to the heel portion 16 when descending downhill. Referring now to FIGS. 5 and 7, the lugs 20, 24, 26, and 28 collapse into the undercuts 22 and 30 in the base 12 on hard, flat surfaces. The concave shape of the lugs provides the lugs with greater flexibility, thereby facilitating collapse of the lugs into the undercuts 22 and 30. In general, this provides the outsole 10 with improved resiliency and increased energy return when weight is lifted from the sole.

Figure 11:
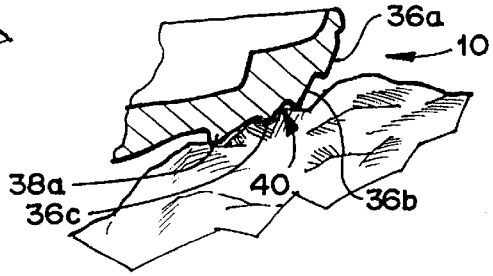
FIG. 11 is a sectional view similar to FIG. 10 showing the toe of the outsole engaging and gripping an uneven surface.
Figure 12:
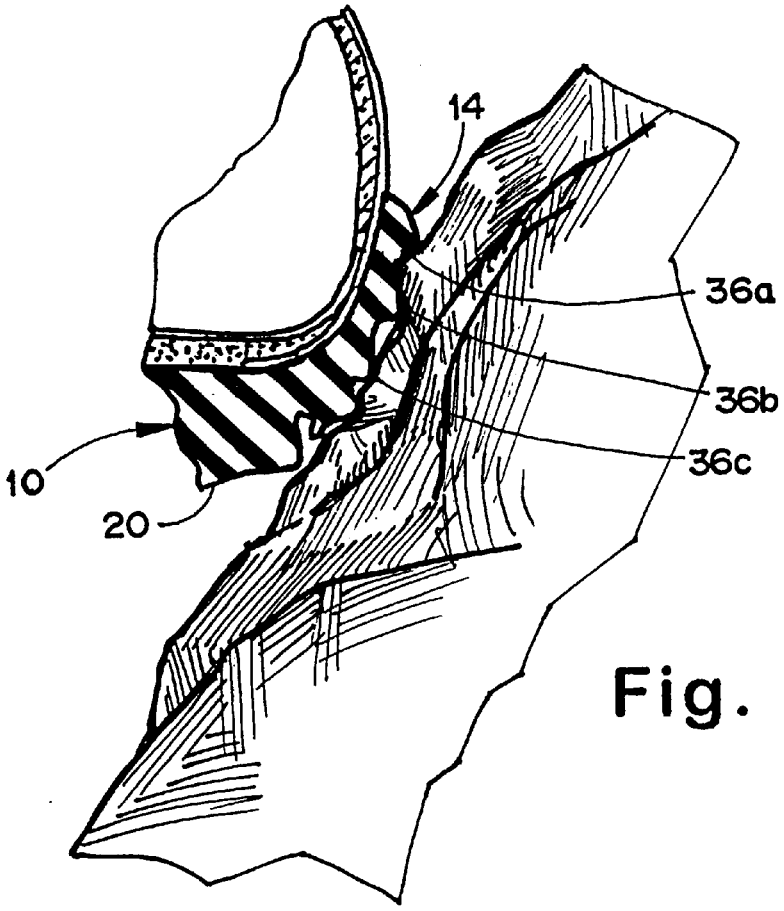
FIG. 12 is a sectional view of a portion of the outsole showing the profile ridges engaging and gripping extreme terrain.

The profile ridges 36*a–c* and ridge segments 38*a–b* are designed to provide the profile 14, including the tapered toe portion 40, with a gripping surface. This provides improved traction when the profile 14 engages the terrain. For example, as shown in FIG. 11, the ridges 36*a–c* and ridge segments 38*a–b* in the toe portion 40 grip uneven surfaces when the toe portion 40 engages the terrain when climbing. The ridges 36*a–c* also provide improved traction when the inside of the profile 14 is used to climb steep terrain (See FIG. 12).

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents.

The embodiments of the invention in which an exclusive property or privilege is claimed are defined as follows:

1. An outsole for an article of footwear comprising:

a substantially horizontally extending base having upper and lower surfaces;

a plurality of lugs extending downwardly from said lower surface of said base, said lugs being manufactured from a flexible and resilient material, said base defining an undercut extending at least partially around each lug, whereby said lugs are capable of collapsing into said base when weight is applied to said outsole on hard, flat surfaces, each of said lugs include a height, said lugs being inclined such that said height of each of said lugs varies along said lug, each of said lugs including a concave major surface; and said outsole including a heel portion and a forefoot portion, said lugs in said heel portion being inclined forwardly and said lugs in said forefoot portion being inclined rearwardly, each of said undercuts includes a depth, said depth of each undercut varying in proportion to said height of a corresponding one of said lugs.

2. The outsole of claim 1 wherein outsole includes a periphery; and said plurality of lugs includes a plurality of peripheral lugs arranged around said periphery of said outsole and a plurality of internal lugs arranged in transverse rows inwardly from said peripheral lugs.

3. The outsole of claim 2 wherein said peripheral lugs are manufactured of a material having a greater durometer than said internal lugs.

4. The outsole of claim 3 further comprising a profile extending upwardly from said periphery of said outsole, said profile including a plurality of downwardly protruding ridges extending around said profile in a substantially horizontal direction to provide said profile with a gripping surface.

5. The outsole of claim 4 wherein a portion of said profile is inclined outwardly from said base to define a tapered toe portion; and at least some of said plurality of ridges wrap beneath said toe portion to provide said toe portion with an inclined gripping surface.

6. The outsole of claim 5 wherein said plurality of ridges undulate in a generally horizontal direction.

7. An outsole for an article of footwear comprising:

a substantially horizontally extending base having a periphery, said periphery having a toe portion and an inside portion; and a profile extending upwardly and outwardly from said base around said periphery, said profile including a plurality of downwardly protruding ridges that extend in a generally horizontal direction along said toe portion and said inside portion of said profile, whereby said ridges provide said profile with a gripping surface, said ridges each including a substantially vertical outer surface and a downwardly inclined bottom surface, said ridges being disposed in a stepped arrangement with adjacent ridges being vertically offset from one another, said profile contoured such that said toe portion is tapered whereby said ridges wrap beneath said outsole at said toe portion.

8. The outsole of claim 7 wherein said profile further defines a protruding ridge segment extending in a generally horizontal direction along said toe portion adjacent said ridges.

9. The outsole of claim 8 wherein said ridges undulate about a generally horizontal line extending along said profile.

10. An outsole for an article of footwear comprising:

a base having a periphery, said periphery having a toe portion and an inside portion, said base including a plurality of downwardly depending lugs, each of said lugs being inclined and including a major surface, each of said lugs including an end wall, said major surface being substantially planar opposite said end wall and increasingly concave toward said end wall, said base defining an undercut extending at least partially around each lug, each of said undercuts including a depth varying in proportion to said height of a corresponding one of said lugs;

a profile extending upwardly from said base around said periphery, said periphery including a plurality of downwardly protruding ridges extending in a generally horizontal direction along said toe portion and said inside portion, said ridges including a substantially vertical outer face and a downwardly inclined bottom face; and said outsole including a heel portion and a forefoot portion, said lugs in said heel portion being inclined forwardly and said lugs in said forefoot portion being inclined rearwardly.

11. The outsole of claim 10 wherein said profile extends upwardly and outwardly from said base, said ridges being disposed in a stepped arrangement with adjacent ridges being vertically offset from one another.

12. The outsole of claim 11 wherein each of said lugs further includes a pair of opposed side walls, said end wall and said pair of opposed side walls of each of said lugs being inclined outwardly from said base.

* * * * *